United States Patent [19]

Breitfeld et al.

[11] Patent Number: 4,660,311

[45] Date of Patent: Apr. 28, 1987

[54] HANDGUN

[76] Inventors: Wolf Breitfeld, Achentalstrasse 10, 8211 Raiten, Fed. Rep. of Germany; Peter Schütz, An der Ag 4, 8221 Siegsdorf, Fed. Rep. of Germany

[21] Appl. No.: 693,113

[22] Filed: Jan. 22, 1985

[30] Foreign Application Priority Data

Jan. 25, 1984 [DE] Fed. Rep. of Germany ..... 3402481

[51] Int. Cl.[4] ..... F41C 23/00

[52] U.S. Cl. ..... 42/72; 42/71.02

[58] Field of Search ..... 42/71 R, 71 P, 72, 73, 42/90, 97, 106

[56] References Cited

U.S. PATENT DOCUMENTS

| | | | |
|---|---|---|---|
| 897,577 | 9/1908 | Bourne | 42/71 R |
| 914,675 | 3/1909 | Renfors | 42/72 |
| 1,695,071 | 12/1928 | Villalpando | 42/71 R |
| 2,056,975 | 10/1936 | Michal, Jr. | 42/72 |
| 2,436,175 | 2/1948 | Neal | 42/71 R |
| 3,162,966 | 12/1964 | Coss | 42/72 |
| 3,184,877 | 5/1965 | Andrews | 42/72 |
| 3,609,902 | 10/1971 | Casull | 42/72 |
| 4,271,623 | 6/1981 | Beretta | 42/73 |
| 4,321,765 | 3/1982 | Gillum | 42/72 |
| 4,513,523 | 4/1985 | Gal | 42/72 |

*Primary Examiner*—Deborah L. Kyle
*Assistant Examiner*—Ted L. Parr
*Attorney, Agent, or Firm*—Erwin S. Teltscher

[57] ABSTRACT

A handgun such as a pistol or revolver, with a grip for handling the weapon, to be held by the hand using the gun, and with a second, additional grip connected to the weapon for the second hand supporting the weapon, wherein the second grip (13) is located at the lower end of the first grip (11) of the weapon (12) and projects outwardly to one side from the first grip (11).

13 Claims, 6 Drawing Figures

FIG. 3
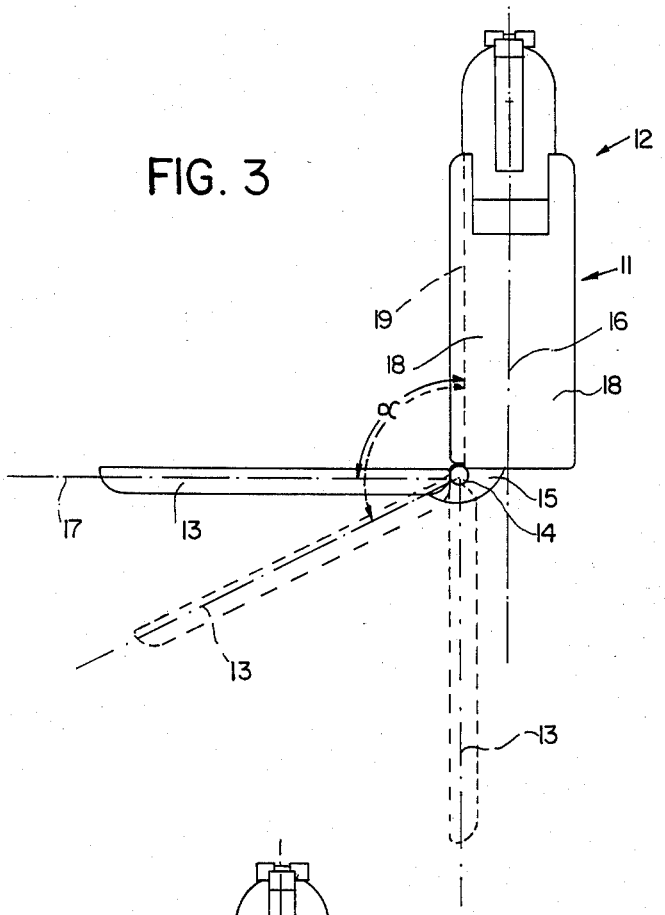
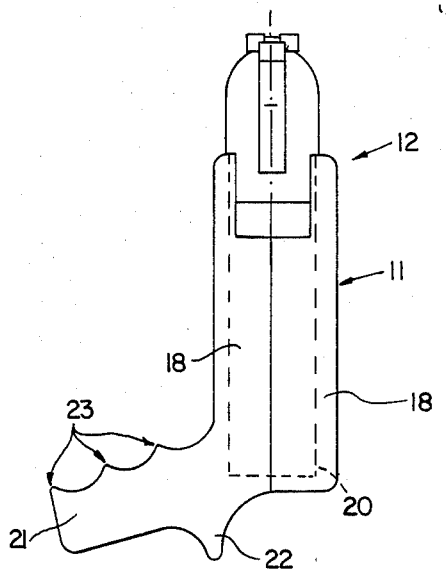
FIG. 4

HANDGUN

BACKGROUND OF THE INVENTION

This invention refers to a handgun, especially a pistol or revolver, with one grip for one hand holding the gun, to enable handling of the weapon during its use, and with an additional, second grip connected to the weapon for the other hand supporting the weapon.

As a rule, handguns are used with only one hand. Firing a shot from a handgun is done with the arm extended, to enable the weapon to be aimed at the target as steadily as possible, so that a sure and well-aimed shot may be fired. Experienced pistol marksmen know that, particularly when it is essential to make rapid use of a handgun, for instance in fighting crime or in self-defense situations, it is difficult to fire accurately. The practice of using the other or second hand to support the first hand holding the weapon has evolved from such situations. This firing position does enable a somewhat steadier aiming and firing of one or more shots; however, this is always to a certain extent a stopgap measure which is not always dependable.

It has already been suggested that a second grip be provided on a handgun in order to enable a more steady and accurate aim, but the proposal according to the U.S. Pat. No. 4,321,765 is by no means suited for practical application, as the second grip is centrally located over the weapon or its barrel, which is more likely in common handguns to lead to a hindrance in using the weapon than an improvement in handling it, particularly in critical situations in which rapid and sure action must be taken.

SUMMARY OF THE INVENTION

The invention is based on the task of improving the two-handed use of a handgun in order to thereby greatly improve the sureness and accuracy of the shot.

To solve this task the proposal according to the invention is to locate the second grip at the lower end of the grip by which the pistol or revolver is held, with this second grip being approximately at right angles to the barrel axis of the handgun and projecting from the first grip toward whichever side the second hand supporting the weapon is located. This means that the second grip extends to the left for a right-handed person and to the right across the first grip for a left-handed person.

The additional second grip can either be detachably connected to the first grip of the weapon or mounted so as to enable it to be pivoted and locked into position. The pivotable attachment offers the advantage of enabling the second grip to be folded against the grip or grip casing of the weapon in order that it may be stored ready for use and within easy reach in a holster. A second grip embodied and mounted in this way does not hinder the sudden drawing of the weapon in order to bring it into firing position. Once the weapon is drawn, it is always possible to swing the second grip into position to enable the weapon to be held steadily and securely with both hands when a shot is fired.

Additional features of the handgun according to the invention can be found in the dependent claims and the following description of several preferred embodiments shown in FIGS. 1 to 5, each of which is a schematic drawing.

BRIEF DESCRIPTION OF THE DRAWINGS

FIG. 3 shows a rear view of the pistol according to FIG. 2.

FIG. 4 shows a rear view of the grip of a pistol or of a correspondingly designed revolver.

DETAILED DESCRIPTION OF THE DRAWINGS

Figure 1:
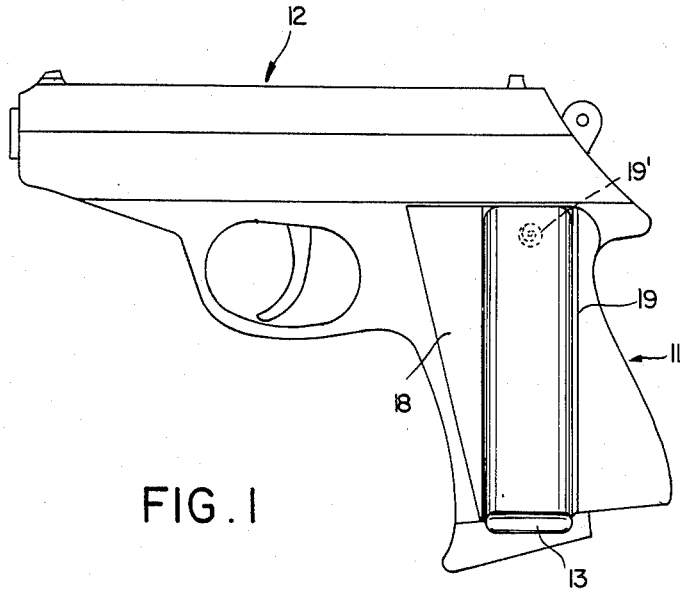
FIG. 1 shows a side view of a pistol with a second, additional grip located on the pistol grip.
Figure 2:
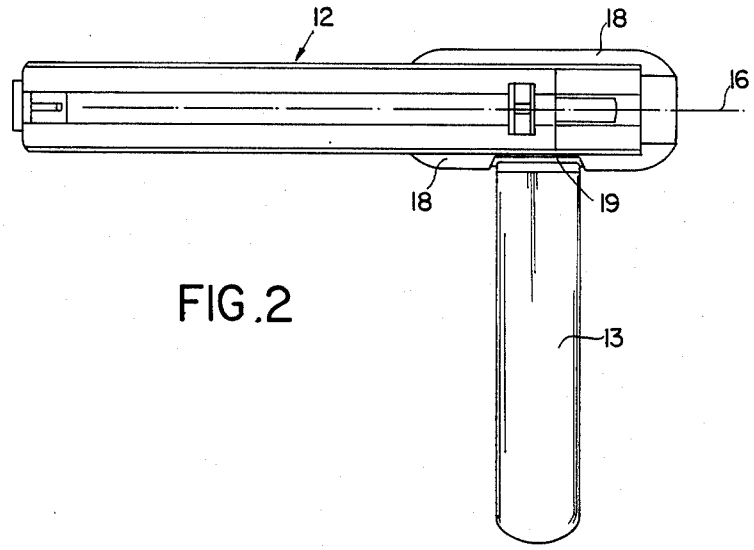
FIG. 2 shows a top view of the pistol according to FIG. 1.

As shown in FIGS. 1 to 4, a second grip (13) is arranged on one side and a lower end of a first grip (11) of the pistol (12), which grip (11) is held in the right hand of a right-handed marksman upon the firing of a shot. This second grip (13) extends for example from the left side of the pistol (12) or from the pistol grip (11) at approximate right angles thereto, as FIG. 2 shows in particular although it may, of course, also extend from the right side of the pistol, as mentioned before. The second grip (13) can be rigidly connected to the first grip (11). This embodiment will be selected especially in the case of special weapons for competitive events or the like, when the bulkiness is of no importance in storing the weapon. However, it is also possible to design the grip (13) to be detachable from the pistol, so as to permit its removal when the weapon is not in use. For secure attachment, the attaching mechanism is provided with a releasable lock.

The additional second grip (13) can also be pivotably hinged to the lower end of the grip (11) by a lockable hinge joint (14) as shown, for example, in FIG. 3; this is designed to limit the pivoting motion, if applicable with the aid of additional stop elements (15), at a certain angular position of the grip (13). Furthermore, locking means, such as the lockable hinge (14) for holding the second grip (13) securely in the desired open position are provided, with no play in order to exclude any wavering of the second grip (13) relative to the first grip (11). The locking means can be implemented, for example, by the hinge joint (14).

A particularly advantageous position for the second grip is one in which the angle $\alpha$ between the vertical plane (16) (FIG. 3) and the center line (17) of the second grip (13) lies approximately between 90° and 130°. The latter position corresponds with the natural position of the fist when the arm is suddenly thrust forward, wherein the fist is then inclined at an angle of approximately 30° to 40° from a horizontal plane.

If the second grip (13) is designed to be folded against the grip (11), it is advantageous to provide a depression (19) in the respective grip casing (18), into which the second grip (13) can be folded so that it lies at least partly in this depression (19), as FIG. 2 shows.

If so desired, the hinging of the second grip (13) can be designed such that it can also be pivoted completely downward to a position parallel with the vertical center plane (16) of the weapon (12), in other words, pivoted within an angular range of 180° as shown, for example, in FIG. 3. In any case the second grip must be provided with means to be securely lockable in each desired position, which can be done by suitable locking means, which, however, must also be swiftly releasable.

An advantageous and successfully tried embodiment of a second grip (13') is shown in FIG. 4. In this embodiment the grip (13') is provided in the shape of a laterally outwardly extending, slightly downwardly inclined handle (21), from which a projection (22) or the like extends downwardly at the end nearest the weapon, to give the thumb of the hand holding the handle (21) a fast and secure hold. Protrusions (23) are advantageously located on the upper side of the handle (21), each of which fits between two fingers and improves the hold. It is essential that the attachment of the additional grip (13) or its pivotal axis (14) on the grip (11) of the weapon (12) be stable. The attachment can be made either on the frame (20) of the grip (11) or on its casing (18).

Figure 5:
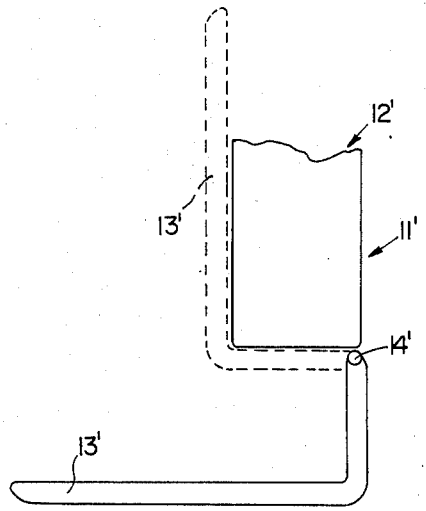
FIG. 5 shows another embodiment according to the invention as applied to a revolver.
Figure 6:
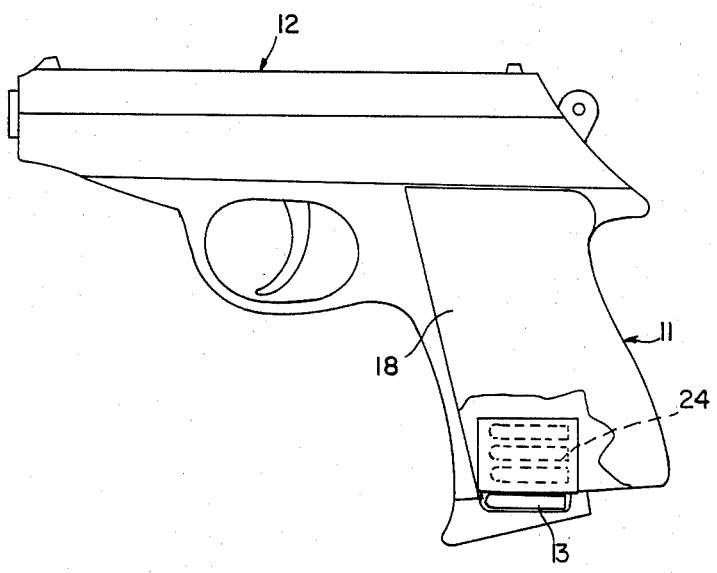
FIG. 6 shows a modified version of the pistol illustrated in FIG. 1.

A specific embodiment to be considered especially for revolvers is shown in FIG. 5. In this embodiment the grip (13') projecting to the left side of the weapon (12') is angular in shape, for example, L-shaped and is pivotably attached by a hinge (14') to the right side of the grip (11'). FIG. 6 illustrates a (spare) cartridge magazine (24) inserted into the first grip (11), shown broken away for the sake of clarity; the second grip (13) will be seen to be attached to the lower end of the cartridge magazine (24).

Trials with a handgun equipped according to the invention have shown that the weapon is far more controllable, especially in critical situations, and clearly allows more certain shots. The scattering of hits is demonstrably smaller by far than in the use of the method common up to now.

We claim:

1. A handgun provided with a first grip for handling the handgun, said first grip extending along a central aiming plane of the handgun and being adapted to be held by one hand of a user using the handgun, and having a second additional grip connected to the handgun and being adapted for the other hand to support the handgun, characterized in that the second grip is located at a lower end of the first grip of the handgun, and projects outwardly from the first grip to one side of the central aiming plane at least while being used to support the handgun.

2. A handgun according to claim 1, characterized in that the second grip is attached to the first grip of the weapon.

3. A handgun according to claim 1, wherein the second grip is pivotably connected to the first grip, so as to occupy a desired position within an angular range of about 180° with respect to the central aiming plane.

4. A handgun according to claim 1, characterized in that the second grip is detachable from the first grip of the weapon.

5. A handgun according to claim 1, characterized in that the second grip subtends a predetermined angle of between approximately 90° to 130° relative to the central aiming plane.

6. A handgun according to claim 1, characterized in that the second grip includes a handle connected to the first grip of the handgun, said handle having a downwardly extending projection located on an inner end thereof, and having protrusions arranged on an upper side thereof.

7. A hand gun according to claim 1, characterized in that the first grip includes a casing, and wherein the second grip is attached to the casing.

8. A handgun according to claim 3, characterized in that the second grip is attached to the lower end of the first grip of the weapon by means of a hingeable connection.

9. A handgun according to claim 1, characterized in that the second grip is mounted to allow it to be folded against the first grip.

10. A handgun according to claim 9, characterized in that the first grip includes a casing, and wherein the second grip, folded against the first one, lies at least partly in a depression in an outer side of the casing.

11. A handgun according to claim 1, characterized in that a cartridge magazine is inserted into said first grip, and wherein the second grip is attached to a lower end of said cartridge magazine.

12. A handgun according to claim 1, characterized in that the second grip is L-shaped.

13. A handgun having a first grip for handling the handgun, said first grip extending along a central aiming plane of the handgun and being adapted to be held by one hand of a user, and having a second grip connected to the handgun, said second grip being adapted for being supported by the other hand of the user, the improvement comprising said second grip being located at a lower end of said first grip, being pivotably connected thereto, and projecting outwardly from the first grip to one side of the central aiming plane so as to occupy a desired position within an angular range of about 180° with respect to the central aiming plane, and locking means for releasably and securely locking said second grip in said desired position.

* * * * *